US007551085B2

(12) United States Patent
Pempsell et al.

(10) Patent No.: US 7,551,085 B2
(45) Date of Patent: Jun. 23, 2009

(54) PASSIVE RESONANT REFLECTOR

(75) Inventors: Mark Pempsell, Bedford, TX (US); Ryan Corley, Austin, TX (US); William J. Langan, Spokane Valley, WA (US)

(73) Assignee: EnXnet, Inc., Tulsa, OK (US)

( * ) Notice: Subject to any disclaimer, the term of this patent is extended or adjusted under 35 U.S.C. 154(b) by 214 days.

(21) Appl. No.: 11/426,501

(22) Filed: Jun. 26, 2006

(65) Prior Publication Data

US 2006/0290589 A1 Dec. 28, 2006

Related U.S. Application Data

(60) Provisional application No. 60/693,666, filed on Jun. 24, 2005.

(51) Int. Cl.
*G08B 13/14* (2006.01)

(52) U.S. Cl. ..... 340/572.1; 29/600; 340/572.7

(58) Field of Classification Search ..... 340/572.1, 340/572.7, 10.1; 29/592, 592.1, 600, 601, 29/825; 343/904, 850

See application file for complete search history.

(56) References Cited

U.S. PATENT DOCUMENTS 5,430,441 A * 7/1995 Bickley et al. ..... 340/572.7
6,104,311 A * 8/2000 Lastinger ..... 340/572.1
6,441,736 B1 * 8/2002 Leighton ..... 340/572.1
7,038,587 B2 * 5/2006 Bellum et al. ..... 340/572.7
2003/0070920 A1 * 4/2003 Shah et al. ..... 204/290.1
2003/0117330 A1 6/2003 Guntersdorfer et al. ..... 343/742
2004/0233042 A1 11/2004 Piccoli et al. ..... 340/10.1

OTHER PUBLICATIONS

PCT Notification of Transmittal of the International Search Report and the Written Opinion of the International Searching Authority, or the Declaration, re PCT/US06/24655 filed Jun. 23, 2006, and mailed Oct. 31, 2007 (8 pages).

* cited by examiner

*Primary Examiner*—Thomas J Mullen
(74) *Attorney, Agent, or Firm*—Baker Botts L.L.P.

(57) ABSTRACT

In accordance with the teachings of the present invention, a passive resonant reflector and a method for the same are provided. In a particular embodiment of the present invention, the passive resonant reflector includes first and second conductive/capacitance layers, one or more insulation layers separating the first and second conductive/capacitance layers, and a transceiver antenna having first and second ends. The first end of the transceiver antenna is coupled to the first conductive/capacitance layer, while the second end of the transceiver antenna is coupled to the second conductive/capacitance layer. The transceiver antenna is operable to receive a transmitted radio frequency signal, charge the first and second conductive/capacitance layers with the received radio frequency signal, and transmit the received radio frequency signal upon a discharge of the first and second conductive/capacitance layers.

17 Claims, 2 Drawing Sheets

PASSIVE RESONANT REFLECTOR

RELATED APPLICATION

This application claims priority to U.S. Provisional Application Ser. No. 60/693,666 filed Jun. 24, 2005.

TECHNICAL FIELD OF THE INVENTION

The present invention relates generally to the field of electronic article surveillance and, more specifically, to a passive resonant reflector and method for the same.

BACKGROUND OF INVENTION

Standard electronic article surveillance (EAS) systems comprise a set of surveillance gates that emit a magnetic pulse along with a resonant frequency. These surveillance gates interact with EAS tags that includes metallic plates that emit the same frequency as that transmitted by the surveillance gates when the tags are in the vicinity of the gates. When this occurs the EAS gate may receive the signal and activater the alarm system of the EAS system.

Previously available EAS tags may be temporarily deactivated using an electromagnetic device that is of a power level of magnetic gauss sufficient to drives the metallic plates in the tag into saturation. Once saturated, these EAS tags are unable to transmit the desired frequency required to activate the alarm of the EAS gates.

SUMMARY OF THE INVENTION

In accordance with the teachings of the present invention, a passive resonant reflector and a method for the same are provided. In a particular embodiment of the present invention, the passive resonant reflector comprises first and second conductive/capacitance layers, one or more insulation layers separating the first and second conductive/capacitance layers, and a transceiver antenna having first and second ends. The first end of the transceiver antenna is coupled to the first conductive/capacitance layer, while the second end of the transceiver antenna is coupled to the second conductive/capacitance layer. The transceiver antenna is operable to receive a transmitted radio frequency signal, charge the first and second conductive/capacitance layers with the received radio frequency signal, and transmit the received radio frequency signal upon a discharge of the first and second conductive/capacitance layers.

In another particular embodiment, the method comprises coupling a first end of a transceiver antenna to a first conductive/capacitance layer, coupling a second end of the transceiver antenna to a second conductive/capacitance layer, and separating the first and second conductive/capacitance layers with one or more insulation layers.

In yet another particular embodiment, the method comprises tagging an object with a passive resonant reflector comprising first and second conductive/capacitance layers, one or more insulation layers separating the first and second conductive/capacitance layers, and a transceiver antenna having first and second ends, the first end of the transceiver antenna coupled to the first conductive/capacitance layer, the second end of the transceiver antenna coupled to the second conductive/capacitance layer. The method also comprises transmitting a first radio frequency signal to the passive resonant reflector such that the first and second conductive/capacitance layers of the passive resonant reflector store the transmitted radio frequency, receiving a second radio frequency signal transmitted by the passive resonant reflector upon a discharge of the first and second conductive/capacitance layers, and signaling an alarm in response to receiving the second radio frequency signal.

A technical advantage of particular embodiments of the present invention may include the ability to receive and transmit a frequency transmitted to the passive resonant reflector via a magnetic pulse carrier. The passive resonant reflector collects the frequency, stores the frequency on the positive upslope of the magnetic sine wave, and, upon crossing the most positive threshold of the magnetic sine wave, transmits the stored frequency in a radiant manner.

Another technical advantage of particular embodiments of the present invention may include the ability to receive and transmit radio frequency signals of different frequencies. Unlike previously available EAS tags that only resonate at a predetermined frequency, particular embodiments of the present invention are able to receive and transmit a variety of frequencies transmitted to the passive resonant reflector via a magnetic pulse carrier.

It will be understood that the various embodiments of the present invention may include some, all, or none of the enumerated technical advantages. In addition other technical advantages of the present invention may be readily apparent to one skilled in the art from the figures, description, and claims included herein.

BRIEF DESCRIPTION OF THE DRAWINGS

For a more complete understanding of the present invention and features and advantages thereof, reference is now made to the following description, taken in conjunction with the accompanying drawings, in which.

DETAILED DESCRIPTION

In accordance with the teachings of the present invention, a passive resonant reflector and a method for the same are provided. In a particular embodiment of the present invention, the passive resonant reflector comprises first and second conductive/capacitance layers, one or more insulation layers separating the first and second conductive/capacitance layers, and a transceiver antenna having first and second ends. The first end of the transceiver antenna is coupled to the first conductive/capacitance layer, while the second end of the transceiver antenna is coupled to the second conductive/capacitance layer. The transceiver antenna is operable to receive a transmitted radio frequency signal, charge the first and second conductive/capacitance layers with the received radio frequency signal, and transmit the received radio frequency signal upon a discharge of the first and second conductive/capacitance layers.

Figure 1:
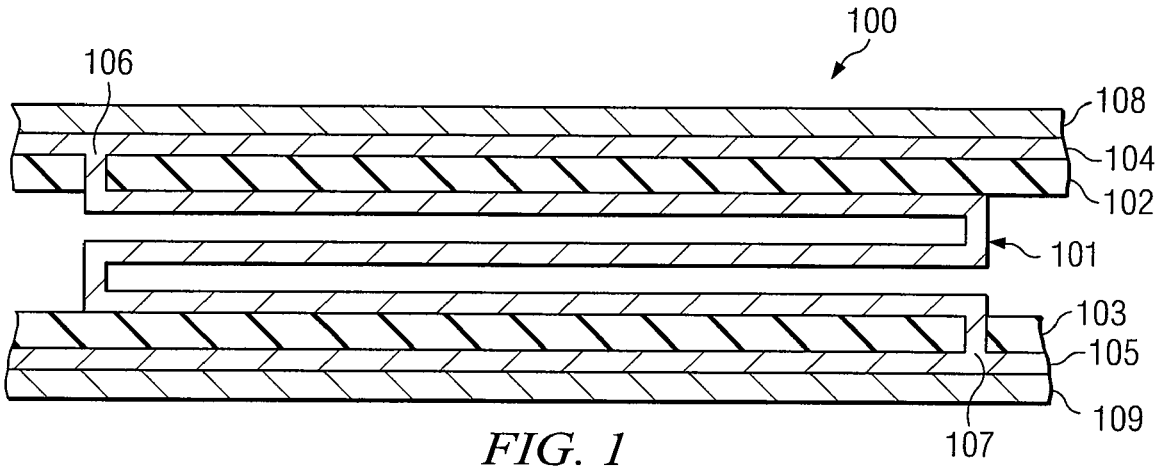
FIG. 1 illustrates a schematic of a passive resonant reflector in accordance with a particular embodiment of the present invention.

FIG. 1 illustrates a passive resonant reflector 100 in accordance with a particular embodiment of the present invention. Generally, passive resonant reflector 100 is a device designed to accompany or replace existing electronic article surveillance tags, such as those used in retail industries for aiding with inventory control. For example, passive resonant reflector 100 may be compatible with a number of suitable EAS technologies in order to identify retail merchandise. As a retail item tagged with passive resonant reflector 100 is passed through an EAS gated area in a retail store, passive resonant reflector 100 may trigger the EAS gates to alert store personnel that someone is attempting to remove the retail item without proper authorization.

As shown in FIG. 1, passive resonant reflector 100 typically comprises a transceiver antenna 101, two insulation layers 102 and 103, and two generally parallel conductive/capacitance layers 104 and 105. In particular embodiments, passive resonant reflector 100 may also comprise protective layers 108 and 109. Although illustrated in FIG. 1 as a side view of a rectangular shape, it should be understood by one of ordinary skill in the art that passive resonant reflector 100 and/or its components may comprise any suitable shape and/or orientation.

Generally, transceiver antenna 101 comprises a coil formed of a suitable material, such as a suitable metal or carbon compound, and having a having a suitable thickness for the reception and transmission of a signal received from an EAS system and a length directly related to the frequency range desired. One end of transceiver antenna 101 passes through insulation layer 102 and is coupled to conductive/capacitance layer 104 at joint 106. The opposite end of transceiver antenna 101 passes through insulation layer 103 and is coupled to conductive/capacitance layer 105 at joint 107. Generally, conductive/capacitance layers 104 and 105 may be formed from any suitable material, such as a flexible conductive compound, such an acetate film, while insulation layers 102 and 103 may be formed from any suitable material, such as Mylar or any other non-conductive insulation material. In particular embodiments of the present invention, joints 106 and 107 may each comprise a diode coupled between transceiver antenna 101 and conductive/capacitance layers 104 and 105, respectively. In such embodiments, these diodes may be used to reduce resonant decay. Regardless of the presence of the diodes, transceiver antenna 101, insulation layers 102 and 103, and conductive/capacitance layers 104 and 105 are then be encapsulated in protective layers 108 and 109, which may be formed from any suitable material having any suitable thickness. So constructed, passive resonant reflector 100 works on the principle of an antenna and capacitor, as conductive/capacitive layers 104 and 105 in conjunction with the insulation layers 102 and 103 act as a capacitor.

When passive resonant reflector 100 comes within the proximity of a set of EAS gates (not illustrated), transceiver antenna 101 absorbs the radio frequency transmitted by the EAS gates. The capacitor formed by conductive/capacitance layers 104 and 105 and insulation layers 102 and 103 then begins to charge with the transmitted radio frequency absorbed by antenna 101. When instructed, the capacitor then discharges the absorbed frequency through antenna 101, which acts as a transmission antenna. In keeping with the operation of the EAS system, when the EAS gates receive the identical signal that they have transmitted, the EAS gates may sound an alarm. Thus, according to particular embodiments of the invention, passive resonant reflector 100 may be considered a variation of a passive trunk circuit.

Perhaps the most prevalent EAS system today is an acousto-magnetic (AM) system which contains an AM tag and a transmitter to create a surveillance area where the AM tag may be detected. The transmitter sends a radio frequency (about 58 KHz in particular embodiments) in pulses, which energizes the AM tag when it is present in the surveillance zone. When the pulse ends, the AM tag responds by emitting a single frequency signal. While the transmitter is off between pulses, the AM tag may be detected by the receiver. A microcomputer checks the AM tag signal detected by the receiver to insure it is at the right frequency, is time synchronized to the transmitter, at the proper level and correct repetition. If all criteria are met, the EAS system may then activate an alarm.

In comparison, in a particular embodiment of the present invention, when the transmitter sends a radio frequency pulse, passive resonant reflector 100 stores the transmitted frequency. When the pulse ends, passive resonant reflector 100 responds by discharging the capacitor, transmitting the previously received radio frequency back to the receiver. The unique characteristics of particular embodiments of passive resonant reflector 100 allow the device to store only the signal sent by the transmitter, ensuring that the signal transmitted by the reflector is at the right frequency, time synchronized to the transmitter, and at the proper level and correct repetition.

As is known in the art, AM materials are highly magnetostrictive. When the tag material is introduced to the magnetic field, it physically shrinks. The greater the magnetic field, the more the tag material shrinks. As a result of driving the AM tag with a magnetic field, the AM tag may be physically changed and driven at a mechanical resonant frequency. When the standard AM tag is introduced to a strong magnetic field, such as a check-out counter at a retail outlet, the magnetostrictive material is brought to saturation. When this occurs, the device may be unable to resonate at the frequency needed to activate the receiver, thus deactivating the tag.

Similarly, when introduced to a strong magnetic field, passive resonant reflector 100 may also be deactivated. When introduced to such a field, conductive/capacitive layers 104 and 105 may become distorted in shape, thereby changing the capacitor characteristics. With the capacitance characteristics changed, the device may be unable to transmit a signal recognizable to the receiver.

Figure 2:
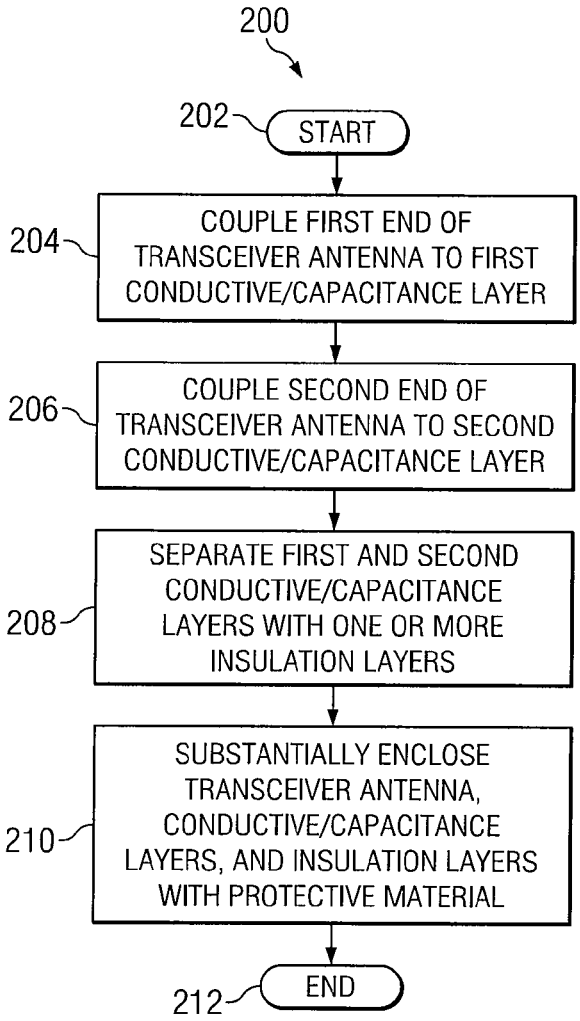
FIG. 2 illustrates a flowchart of a method of constructing a passive resonant reflector in accordance with a particular embodiment of the present invention.
Figure 3:
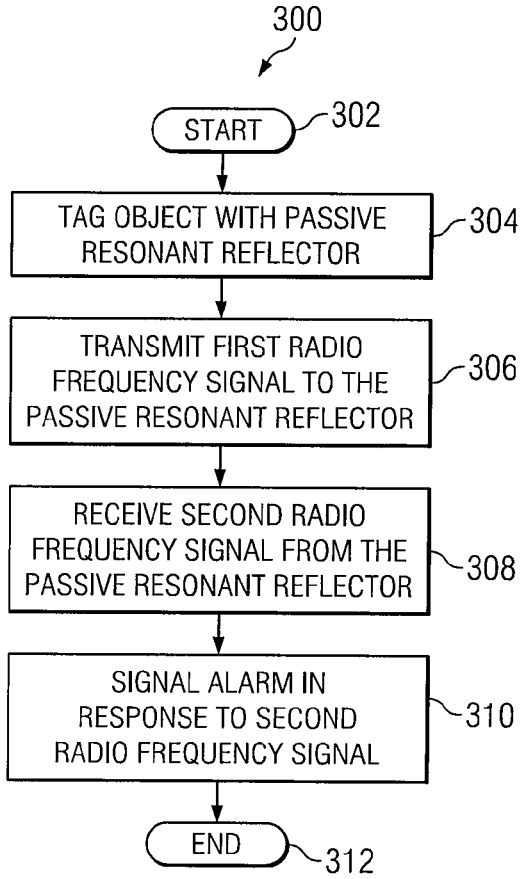
FIG. 3 illustrates a flowchart of a method of electronically source tagging an object in accordance with a particular embodiment of the present invention.

A better understanding of the present invention may be had by making reference to FIGS. 2 and 3, which illustrate two different flowcharts. FIG. 2 illustrates a flowchart 200 of a method of constructing a passive resonant reflector 100 in accordance with a particular embodiment of the present invention. Flowchart 200 begins at step 202. At step 204, the first end of transceiver antenna 101 is coupled to first conductive/capacitance layer 104. In particular embodiments, this may be done using a diode to help reduce resonant decay. At step 206, the second end of transceiver antenna 101 is coupled to second conductive/capacitance layer 105. In particular embodiments, this may also be done using a diode to help reduce resonant decay. At step 208, the first and second conductive/capacitance layers 104 and 105 are separated by one or more insulation layers. In particular embodiments, these one or more layers comprise a first insulation layer 102 coupled to first conductive/capacitance layer 104 and a second insulation layer 103 coupled to a second conductive/capacitance layer 105. At step 210, transceiver antenna 101, first and second conductive/capacitance layers 104 and 105, and one or more insulation layers are then substantially enclosed by a protective layer. Lastly, at step 212, flowchart 200 terminates.

FIG. 3 illustrates a flowchart 300 of a method of electronically source tagging an object in accordance with a particular embodiment of the present invention. Flowchart 300 begins at step 302. At step 304, an object is tagged with a passive resonant reflector. In particular embodiments, this passive resonant reflector comprises a transceiver antenna, first and second conductive/capacitance layers, and one or more insulation layers, and is constructed as discussed above in regard to FIGS. 1 and 2. At step 306, a radio frequency signal is transmitted to the passive resonant reflector by an EAS system. This signal is received by the transceiver antenna of the passive resonant reflector, which in turn charges the conductive/capacitance layers, effectively storing the received signal. At step 308, the conductive/capacitance layers discharge, transmitting this stored radio frequency signal through the transceiver antenna. This stored radio frequency signal is then received by the EAS system. In response to the receipt of the stored radio frequency signal, the EAS system may then signal an alarm at step 310. Finally, at step 312, flowchart 300 ends.

Figure 4:
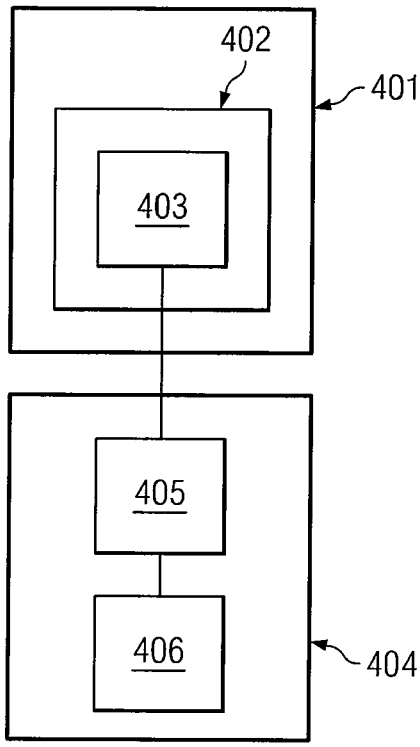
FIG. 4 illustrates various components associated with the method described in connection with FIG. 3.

FIG. 4 illustrates various components associated with the method described in connection with FIG. 3. Object 401 is tagged with passive resonant reflector 402, which has transceiver 403. EAS system 404 has transceiver 405 and signal generator 406. Transceiver 405 transmits the first radio frequency signal to transceiver 403 of passive resonant reflector 403. Transceiver 403 transmits a second radio frequency signal which is received by transceiver 405 of EAS system 404. In response to the receipt of the second radio frequency signal, signal generator 406 signals an alarm.

As can be understood from the above description, passive resonant reflectors in accordance with a particular embodiment of the present invention offer the ability to receive and transmit a frequency transmitted to the passive resonant reflector via a magnetic pulse carrier. The passive resonant reflector collects the frequency, stores the frequency on the positive upslope of the magnetic sine wave, and, upon crossing the most positive threshold of the magnetic sine wave, transmits the stored frequency in a radiant manner. Unlike previously available EAS tags that only resonate at a predetermined frequency, passive resonant reflectors in accordance with particular embodiments of the present invention are also able to receive and transmit a variety of frequencies transmitted to the passive resonant reflector via a magnetic pulse carrier.

Although particular embodiments of the method and apparatus of the present invention have been illustrated in the accompanying drawings and described in the foregoing detailed description, it will be understood that the invention is not limited to the embodiments disclosed, but is capable of numerous rearrangements, modifications, and substitutions without departing from the spirit of the invention as set forth and defined by the following claims.

What is claimed is:

1. A passive resonant reflector, comprising:

first and second conductive/capacitance layers;

one or more insulation layers separating the first and second conductive/capacitance layers;

a transceiver antenna having first and second ends; and a first diode coupling the first end of the transceiver antenna to the first conductive/capacitance layer, the second end of the transceiver antenna coupled to the second conductive/capacitance layer;

wherein the transceiver antenna is operable to receive a transmitted radio frequency signal, charge the first and second conductive/capacitance layers with the received radio frequency signal, and transmit the received radio frequency signal upon a discharge of the first and second conductive/capacitance layers.

2. The passive resonant reflector of claim 1, further comprising a protective coating substantially enclosing the first and second conductive/capacitance layers, one or more insulation layers, and transceiver antenna.

3. The passive resonant reflector of claim 1, further comprising a second diode coupling the second end of the transceiver antenna to the second conductive/capacitance layer.

4. The passive resonant reflector of claim 1, wherein the transceiver antenna comprises metal.

5. The passive resonant reflector of claim 1, wherein the transceiver antenna comprises a carbon compound.

6. The passive resonant reflector of claim 1, wherein the first and second conductive/capacitance layers comprise an acetate film.

7. The passive resonant reflector of claim 1, wherein the one or more insulation layers comprise Mylar.

8. A passive resonant reflector, comprising:

first and second conductive/capacitance layers;

one or more insulation layers separating the first and second conductive/capacitance layers; and a transceiver antenna having first and second ends, the first end of the transceiver antenna coupled to the first conductive/capacitance layer, the second end of the transceiver antenna coupled to the second conductive/capacitance layer;

wherein the transceiver antenna is operable to receive a transmitted radio frequency signal, charge the first and second conductive/capacitance layers with the received radio frequency signal, and transmit the received radio frequency signal upon a discharge of the first and second conductive/capacitance layers; and wherein the passive resonant reflector is operable to be disarmed by applying a magnetic field to the passive resonant reflector sufficient to alter a capacitance property of the first and second conductive/capacitance layers.

9. A method for forming a passive resonant reflector, comprising:

coupling a first end of a transceiver antenna to a first conductive/capacitance layer with a first diode;

coupling a second end of the transceiver antenna to a second conductive/capacitance layer; and separating the first and second conductive/capacitance layers with one or more insulation layers.

10. The method of claim 9, further comprising substantially enclosing the first and second conductive/capacitance layers, one or more insulation layers, and transceiver antenna within a protective layer.

11. The method of claim 9, wherein coupling the second end of the transceiver antenna to the second conductive/capacitance layer comprises coupling the second end of the transceiver antenna to the second conductive/capacitance layer with a second diode.

12. The method of claim 9, wherein the transceiver antenna comprises metal.

13. The method of claim 9, wherein the transceiver antenna comprises a carbon compound.

14. The method of claim 9, wherein the first and second conductive/capacitance layers comprise an acetate film.

15. The method of claim 9, wherein the one or more insulation layers comprise Mylar.

16. A method of electronically source tagging an object, comprising:

tagging an object with a passive resonant reflector comprising first and second conductive/capacitance layers, one or more insulation layers separating the first and second conductive/capacitance layers, and a transceiver antenna having first and second ends, the first end of the transceiver antenna coupled to the first conductive/capacitance layer, the second end of the transceiver antenna coupled to the second conductive/capacitance layer;

transmitting a first radio frequency signal to the passive resonant reflector such that the first and second conductive/capacitance layers of the passive resonant reflector store the transmitted radio frequency;

receiving a second radio frequency signal transmitted by the passive resonant reflector upon a discharge of the first and second conductive/capacitance layers;

signaling an alarm in response to receiving the second radio frequency signal; and disarming the passive resonant reflector by applying a magnetic field to the passive resonant reflector sufficient to alter a capacitance property of the first and second conductive/capacitance layers.

17. The method of claim 16, wherein the first and second radio frequency signals are substantially identical.

* * * * *